US009670927B2

(12) United States Patent
Kii

(10) Patent No.: US 9,670,927 B2
(45) Date of Patent: Jun. 6, 2017

(54) SCROLL COMPRESSOR WITH A BALANCER AND ELASTIC MEMBER

(71) Applicant: KABUSHIKI KAISHA TOYOTA JIDOSHOKKI, Kariya-shi, Aichi (JP)

(72) Inventor: Norimichi Kii, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 444 days.

(21) Appl. No.: 14/196,546

(22) Filed: Mar. 4, 2014

(65) Prior Publication Data

US 2014/0255231 A1 Sep. 11, 2014

(30) Foreign Application Priority Data

Mar. 6, 2013 (JP) ..... 2013-044044

(51) Int. Cl.
*F04C 18/02* (2006.01)
*F04C 29/00* (2006.01)

(52) U.S. Cl.
CPC ..... *F04C 18/0207* (2013.01); *F04C 18/0215* (2013.01); *F04C 29/0021* (2013.01); *F04C 2240/807* (2013.01); *F04C 2270/13* (2013.01)

(58) Field of Classification Search
CPC ..... F04C 2240/807; F04C 2270/13; F04C 29/0021; F04C 18/0207; F04C 18/0215
See application file for complete search history.

(56) References Cited

U.S. PATENT DOCUMENTS 5,458,472 A 10/1995 Kobayashi et al.
5,681,155 A 10/1997 Hisanaga et al.
6,454,551 B2 * 9/2002 Kuroki ..... F04C 18/0215 418/151

(Continued)

FOREIGN PATENT DOCUMENTS

EP 2378124 A1 10/2011
EP 2667029 A1 11/2013

(Continued)

OTHER PUBLICATIONS

Communication dated Mar. 22, 2016, from the Japanese Patent Office in counterpart application No. 2013-044044.

(Continued)

*Primary Examiner* — Mary A Davis
(74) *Attorney, Agent, or Firm* — Sughrue Mion, PLLC

(57) ABSTRACT

A scroll compressor comprises a housing, a cylindrical rotating shaft, a fixed scroll, a movable scroll, and a drive mechanism. The drive mechanism includes an eccentric pin, and a balancer-integrated bush. The eccentric pin extends in parallel with the rotating shaft from the end part of the rotating shaft. The balancer-integrated bush is disposed between the eccentric pin and the movable scroll, includes an eccentric hole into which the eccentric pin is inserted, and configured to rotate around the eccentric pin, and further includes a balancer in an integrated manner, and is configured to rotatably move relative to the rotating shaft. An elastic member is disposed between the balancer-integrated bush and at least one of the rotating shaft and the eccentric pin, and the elastic member regulates the relatively movable range of the rotating shaft and the balancer-integrated bush.

18 Claims, 13 Drawing Sheets

(56) References Cited

U.S. PATENT DOCUMENTS

| | | | | |
|---|---|---|---|---|
| 6,506,036 | B2 * | 1/2003 | Tsubai | F04C 27/009 417/369 |
| 7,021,912 | B2 * | 4/2006 | Tsuchiya | F04C 29/0021 418/55.1 |
| 7,175,402 | B2 * | 2/2007 | Lee | F04C 18/0215 418/182 |
| 8,602,756 | B2 * | 12/2013 | Takeuchi | F04C 18/0215 418/151 |
| 2006/0254309 | A1 | 11/2006 | Takeuchi et al. | |
| 2011/0280758 | A1 | 11/2011 | Takeuchi et al. | |
| 2012/0237381 | A1 | 9/2012 | Murakami | |
| 2015/0198161 | A1 * | 7/2015 | Tozawa | F04C 18/0215 418/55.3 |

FOREIGN PATENT DOCUMENTS

| | | | |
|---|---|---|---|
| EP | 2713053 | A1 | 4/2014 |
| JP | 59107081 | U | 7/1984 |
| JP | 08159052 | A | 6/1996 |
| JP | 2001-248572 | A | 9/2001 |
| JP | 2002-285979 | A | 10/2002 |
| JP | 3781460 | B2 | 5/2006 |
| JP | 2006-342793 | A | 12/2006 |
| JP | 2008-208717 | A | 9/2008 |
| JP | 2010150963 | A | 7/2010 |
| JP | 2012-149572 | A | 8/2012 |
| JP | 2012-189043 | A | 10/2012 |
| JP | 2012225328 | A | 11/2012 |

OTHER PUBLICATIONS

Communication dated Apr. 9, 2015, issued by the Korean Intellectual Property Office in counterpart Application No. 10-2014-0025619.

Communication dated Apr. 7, 2015 from the European Patent Office in counterpart Application No. 14157761.9.

Communication dated Dec. 14, 2016, from the European Patent Office in counterpart European Application No. 14157761.9.

* cited by examiner

SCROLL COMPRESSOR WITH A BALANCER AND ELASTIC MEMBER

CROSS-REFERENCE TO RELATED APPLICATION(S)

This application claims priority to Japanese Patent Application No. 2013-044044 filed on Mar. 6, 2013, the contents of which are hereby incorporated by reference into the present application.

TECHNICAL FIELD

The present application relates to a scroll compressor.

DESCRIPTION OF RELATED ART

A scroll compressor adopts a mechanism which enables the orbital radius of the movable scroll to be variable in order to appropriately maintain the contact pressure of the movable scroll and the fixed scroll. An example of the foregoing mechanism is the swing link mechanism. Japanese Patent Application Publication No. 2008-208717 discloses, as an example of the swing link mechanism, a scroll compressor in which an eccentric hole is formed at an eccentric position of a bush. A drive pin is disposed at a position that is eccentric from the center axis on one end surface of the main axis, and the drive pin inserted rotatably into the eccentric hole of the bush. Consequently, when the main axis is driven, the movable scroll that is rotatably supported by the bush orbits about the drive pin, and the orbital radius of the movable scroll can thereby be changed.

BRIEF SUMMARY OF INVENTION

With the conventional scroll compressor described above, the bush continues to rotate due to inertial force even when the scroll compressor is stopped and the drive of the main axis is stopped. Here, the bush rotates about the drive pin. Thus, the main axis and the bush collides and generate a relatively large noise.

This specification provides technology for reducing the abnormal noise that is generated when the scroll compressor stops.

A scroll compressor comprises a housing, a cylindrical rotating shaft rotatably supported by the housing, a fixed scroll fixed to the housing, a movable scroll which opposes the fixed scroll to form a compressing chamber, and a drive mechanism disposed in the housing and configured to allow the movable scroll to make an orbital motion by rotation of the rotating shaft. The drive mechanism includes an eccentric pin extending in parallel with the rotating shaft from an end part of the rotating shaft, and a balancer-integrated bush disposed between the eccentric pin and the movable scroll, including an eccentric hole into which the eccentric pin is inserted, configured to rotate around the eccentric pin, further including a balancer in an integrated manner, and configured to rotatably move relative to the rotating shaft. An elastic member is disposed between the balancer-integrated bush and at least one of the rotating shaft and the eccentric pin, and the elastic member regulates a relatively movable range in which the balancer-integrated bush rotatably moves around the rotating shaft relative to the rotating shaft.

DETAILED DESCRIPTION OF INVENTION

Figure 1:
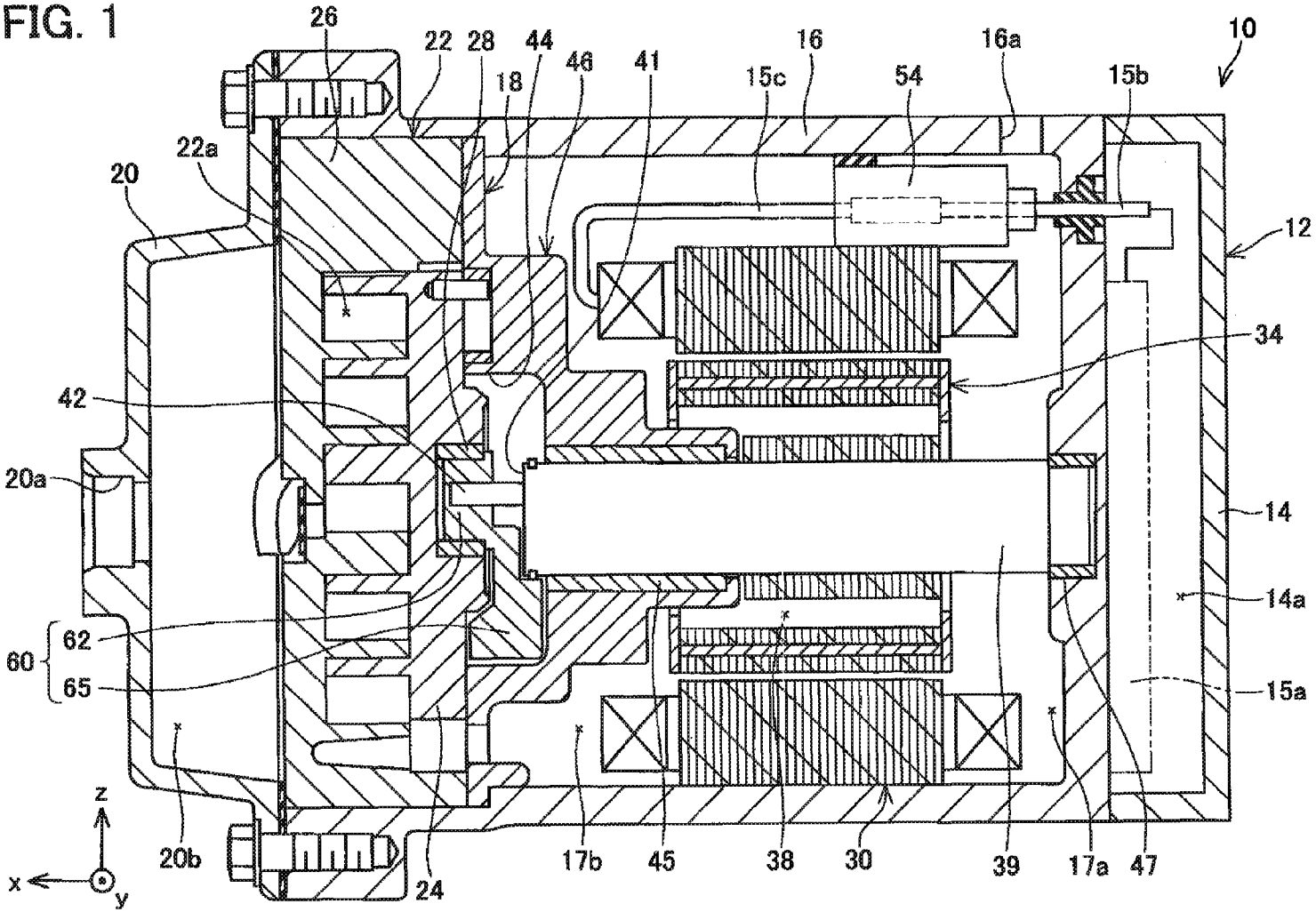
FIG. 1 is a cross-sectional view of the scroll compressor according to a first embodiment.

In one aspect of the present teachings, there may exist a non-adjacent state in which the elastic member is not in abutment with either the balancer-integrated bush or at least one of the rotating shaft and the eccentric pin within the relatively movable range. According to the foregoing configuration, in comparison to a configuration where the elastic member is always in abutment with the balancer-integrated bush and at least one of the rotating shaft and the eccentric pin in a relatively movable range, the relatively movable range of the balancer-integrated bush increases. Thus, the balancer-integrated bush can appropriately adjust the pressing force of the movable scroll applied to the fixed scroll that is generated by the orbital motion of the movable scroll. In particular, even when the centrifugal force increases during the high-speed rotation of the scroll compressor, by the balancer-integrated bush rotatably moving around the rotating shaft relative to the rotating shaft, the balancer-integrated bush offsets the centrifugal force of the movable scroll, and increase in the pressing force of the scroll wall surfaces of the movable scroll and the fixed scroll can be inhibited.

In another aspect of the present teachings, the elastic member may be always in abutment with at least one of the rotating shaft and the eccentric pin and the balancer-integrated bush within the relatively movable range. According to the foregoing configuration, the rotational resistance of the balancer-integrated bush increases due to the elastic member. Thus, when the rotating shaft stops, the balancer-integrated bush gradually decelerates and then stops. Accordingly, the collision noise of when the balancer-integrated bush stops is reduced.

In another aspect of the present teachings, the balancer-integrated bush may comprise a body and a projecting portion which projects in parallel with the rotating shaft from the body towards the rotating shaft. The projecting portion may include a first opposing surface opposing a peripheral surface of the rotating shaft. The body may include a second opposing surface opposing an end surface of the rotating shaft. The first opposing surface and the second opposing surface may form a concaved portion capable of accommodating the end part of the rotating shaft. According to the foregoing configuration, when the rotating shaft stops, the balancer-integrated bush stops as a result of colliding with the end part of the rotating shaft. Here, since the impact during collision is lightened by the elastic member, the abnormal noise during the collision of the rotating shaft and the balancer-integrated bush can be reduced.

In another aspect of the present teachings, the balancer-integrated bush may include a first opposing surface opposing a peripheral surface of the rotating shaft. The elastic member may be attached to a part opposing the first opposing surface within the peripheral surface of the rotating shaft, or to the first opposing surface, or to a combination thereof. According to the foregoing configuration, an elastic member is disposed between the first opposing surface of the balancer-integrated bush and the peripheral surface of the rotating shaft, and the elastic member comes into abutment with both the balancer-integrated bush and the rotating shaft when the rotating shaft and the balancer-integrated bush collide. Consequently, the impact during the collision of the rotating shaft and the balancer-integrated bush is lightened. Thus, the abnormal noise during the collision of the rotating shaft and the balancer-integrated bush can be reduced.

In another aspect of the present teachings, the balancer-integrated bush may include a projecting portion having a first opposing surface opposing a peripheral surface of the rotating shaft. The elastic member may be a ring shaped elastic member. The ring shaped elastic member may be attached to the rotating shaft, or to the projecting portion, or to a combination thereof. According to the foregoing configuration, by using a ring shaped elastic member, the elastic member can be easily attached to the balancer-integrated bush or to the rotating shaft.

In the other aspect of the present teachings, the eccentric pin may include an exposed portion exposed to outside the eccentric hole. A ring shaped elastic member may be attached to a peripheral surface of the exposed portion. The ring shaped elastic member may be in abutment with the balancer-integrated bush. According to the foregoing configuration, the ring shaped elastic member is attached to the exposed portion of the eccentric pin, and the ring shaped elastic member also comes into abutment with the balancer-integrated bush. According to the foregoing configuration, friction force is generated between the elastic member, which is attached to the eccentric pin, and the balancer-integrated bush, and the resistance during the rotation of the balancer-integrated bush about the eccentric pin increases. Thus, the rotating speed of the balancer-integrated bush decreases and the impact of the balancer-integrated bush colliding with the rotating shaft when the scroll compressor stops weakens. Accordingly, the abnormal noise during the collision of the rotating shaft and the balancer-integrated bush can be reduced. Moreover, when the scroll compressor starts, the balancer-integrated bush rotates relatively in a direction that is opposite to the direction of when the scroll compressor stops, and there are cases in which the scroll wall surface of the movable scroll collides with the scroll wall surface of the fixed scroll, thereby generating abnormal noise. According to the foregoing configuration, when the scroll compressor starts, since the rotating speed of the balancer-integrated bush gradually increases, the abnormal noise between the movable scroll and the fixed scroll can also be reduced.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide an improved scroll compressor.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EMBODIMENTS

The overall configuration of the scroll compressor 10 according to a first embodiment is now explained with reference to FIG. 1. Note that, in the ensuing drawings, a part of the hatching is omitted in the cross sections. As shown in FIG. 1, the scroll compressor 10 comprises a housing 12, a cylindrical rotating shaft 39 rotatably supported by the housing 12, and electric motor (30, 34) and a compression unit 22 housed inside the housing 12. The electric motor (30, 34) is disposed on one end side (right end side of FIG. 1) of the rotating shaft 39, and the compression unit 22 is disposed on the other end side of the rotating shaft 39. In other words, the electric motor (30, 34) and the compression unit 22 are disposed along the axial direction of the rotating shaft 39. As described later, when the electric motor (30, 34) drives the rotating shaft 39, the compression unit 22 is driven by the rotating shaft 39.

The housing 12 comprises a bottomed cylindrical motor housing 16, a front housing 18 mounted inside the motor housing 16, and a discharge housing 20 for closing the open end (left end of FIG. 1) of the motor housing 16.

The motor housing 16 is formed from a metal material (for instance, aluminum or the like). An inlet port 16*a* is formed on the side face of the motor housing 16. The inlet port 16*a* is positioned near the bottom wall (right end of FIG. 1) of the motor housing 16. A slide bearing 47 for rotatably supporting one end (right end of FIG. 1) of the rotating shaft 39 is disposed on the bottom wall of the motor housing 16. Note that a cover 14 is mounted on the bottom wall of the motor housing 16. A motor drive circuit 15*a* is housed inside a housing space 14*a* formed from the motor housing 16 and the cover 14.

The front housing 18 is formed from a metal material (for instance, aluminum or the like). When the front housing 18 is mounted in the motor housing 16, the space inside the motor housing 16 is partitioned into a space (space on the right side of the front housing 18 in FIG. 1) for housing the electric motor (30, 34), and a space (space on the left side of the front housing 18 in FIG. 1) for housing the compression unit 22. A projecting portion 46 which projects toward the electric motor (30, 34) is formed on the front housing 18. A slide bearing 45 which rotatably supports the other end (left end of FIG. 1) of the rotating shaft 39 is disposed on the projecting portion 46. A concaved portion 44 is formed on a face on the side of the compression unit 22 of the front housing 18. The concaved portion 44 is positioned between the front housing 18 and the compression unit 22, and houses the balancer-integrated bush 60 described later.

A discharge housing 20 is formed in a bottomed cylindrical shape, and formed from a metal material (for instance, aluminum or the like). A discharge port 20*a* is formed on the discharge housing 20. When the discharge housing 20 is mounted on the motor housing 16, a discharge chamber 20*b* is formed between the compression unit 22 and the discharge housing 20. The discharge chamber 20*b* is in communication with the outside via the discharge port 20*a*. The pressure of the refrigerant of the concaved portion 44 is maintained at an intermediate pressure between the pressure of the refrigerant of the inlet port 16*a* (low pressure) and the pressure of the refrigerant of the discharge port 20*a* (high pressure), and becomes a back pressure region. Consequently, the movable scroll 24 (described later) is pressed against the fixed scroll 26 (described later), and thus the leakage of the refrigerant is prevented and the appropriate operation of the movable scroll 24 is enabled.

The rotating shaft 39 is housed in the housing 12. As described above, one end of the rotating shaft 39 is rotatably supported by the slide bearing 47 disposed in the housing 12, and the other end of the rotating shaft 39 is rotatably supported by the slide bearing 45 disposed in the front housing 18. An eccentric pin 42 is disposed on the other end surface 41 of the rotating shaft 39. The eccentric pin 42 is disposed at a position that is eccentric from the center axis of the rotating shaft 39, and extends in parallel with the rotating shaft 39 from the other end surface 41 of the rotating shaft 39 toward the compression unit 22. A balancer-integrated bush 60 is rotatably mounted on the eccentric pin 42. The balancer-integrated bush 60 can rotatably move relative to the rotating shaft 39.

The electric motor (30, 34) is housed in the spaces (17*a*, 17*b*) on the side of the bottom wall in the motor housing 16. The electric motor (30, 34) comprises a rotor 34 fixed to the rotating shaft 39, and a stator coil 30 wound with a coil wire and disposed on the outer peripheral side of the rotor 34. When the electric motor (30, 34) is fixed to the inner wall surface of the motor housing 16, the spaces (17*a*, 17*b*) on the side of the bottom wall in the motor housing 16 are partitioned into a space 17*a* on the side of the motor drive circuit 15*a* and a space 17*b* on the side of the compression unit 22 in the axial direction of the rotating shaft 39 across the electric motor (30, 34). A flow path 38 is formed in the rotor 34. As evident from the diagrams, the flow path 38 causes the space 17*a* and the space 17*b* to be in communication.

The compression unit 22 is housed in a space on the open end side in the motor housing 16 (in FIG. 1, space that is more leftward than the front housing 18). The compression unit 22 comprises a fixed scroll 26 fixed to the motor housing 16, and a movable scroll 24 opposing the fixed scroll 26. A compressing chamber 22*a* is formed between the fixed scroll 26 and the movable scroll 24 as a result of a scroll wall surface of the fixed scroll 26 and a scroll wall surface of the movable scroll 24 engaging with each other. The volume of the compressing chamber 22*a* changes pursuant to the orbital motion of the movable scroll 24. The compressing chamber 22*a* sucks in a refrigerant through the space 17*a*, and discharges the refrigerant through the discharge chamber 20*b*. The movable scroll 24 is rotatably mounted on the balancer-integrated bush 60 via a slide bearing 28. As described above, the balancer-integrated bush 60 is mounted on the eccentric pin 42. Thus, when the rotating shaft 39 rotates, the movable scroll 24 makes an orbital motion via the eccentric pin 42.

Note that the coil wire of the electric motor (30, 34) is connected to the motor drive circuit 15*a* via a lead wire 15*c*, a cluster block 54 and a terminal 15*b*. The cluster block 54 is fixed to the peripheral surface of the stator coil 30.

The operation of the foregoing scroll compressor 10 is now explained. When the motor drive circuit 15*a* supplies power to the electric motor (30, 34), the rotor 34 and the rotating shaft 39 start rotating integrally. When the rotating shaft 39 rotates, that rotation is transmitted to the movable scroll 24 via the eccentric pin 42 and the balancer-integrated bush 60. Consequently, the movable scroll 24 orbits, and the volume of the compressing chamber 22*a* between the movable scroll 24 and the fixed scroll 26 changes.

The refrigerant sucked in from the inlet port 16*a* flows through the space 17*a* in the motor housing 16 and cools one coil end of the stator coil 30. Subsequently, the refrigerant in the space 17*a* passes through the flow path 38 formed on the rotor 34, and flows to the space 17*b*. The rotor 34 is cooled by the refrigerant flowing in the flow path 38.

The refrigerant that flowed into the space 17*b* is sucked into the compressing chamber 22*a* of the compression unit 22. The refrigerant that was sucked into the compressing chamber 22*a* is compressed pursuant to the rotation of the movable scroll 24. The refrigerant that was compressed in the compressing chamber 22*a* is discharged to the discharge chamber 20*b*, and discharged outside the housing 12 by the discharge port 20*a*.

Figure 2:
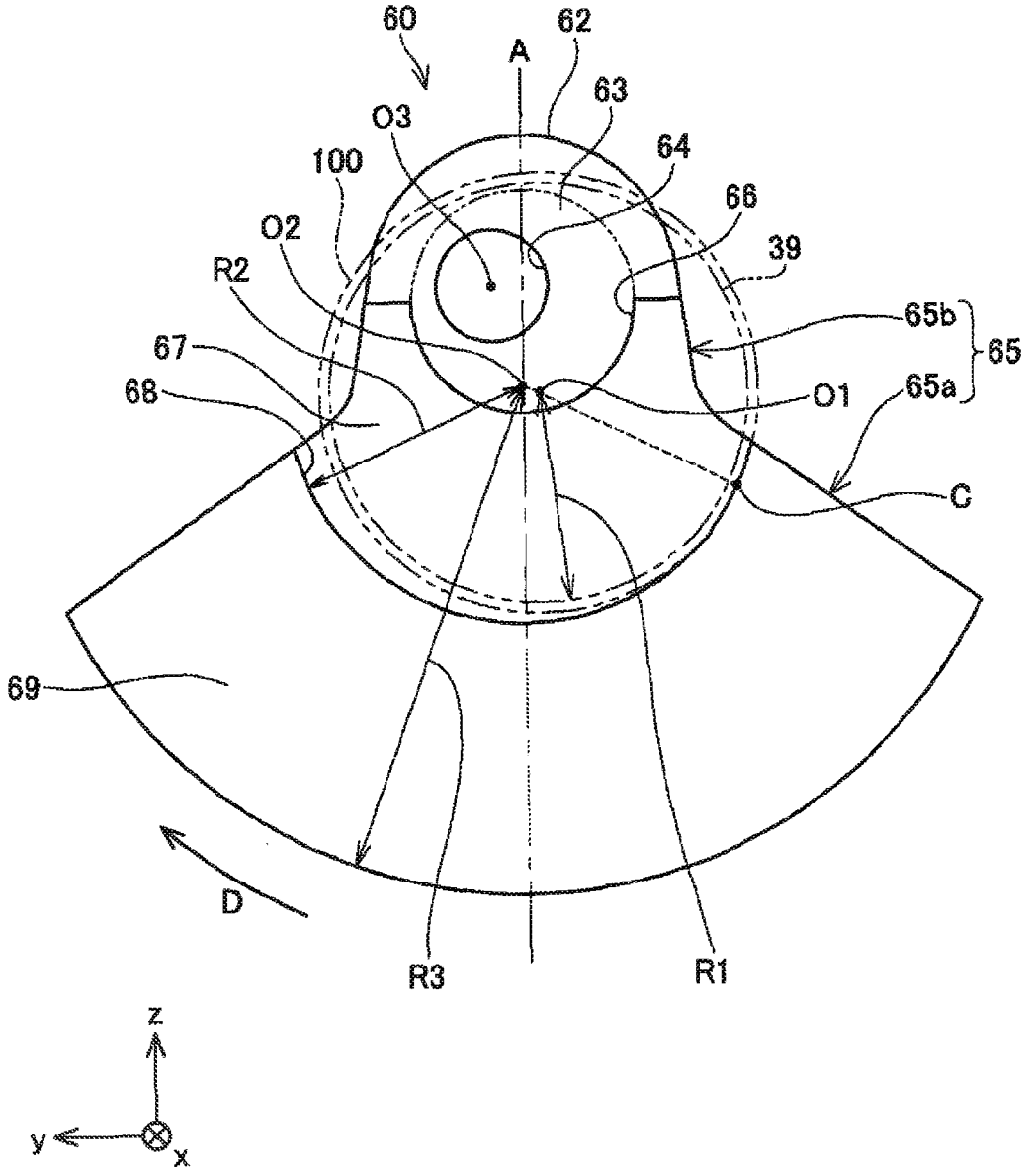
FIG. 2 shows the positional relation of the balancer-integrated bush and the rotating shaft in a state where the balancer-integrated bush is colliding with the rotating shaft.
Figure 3:
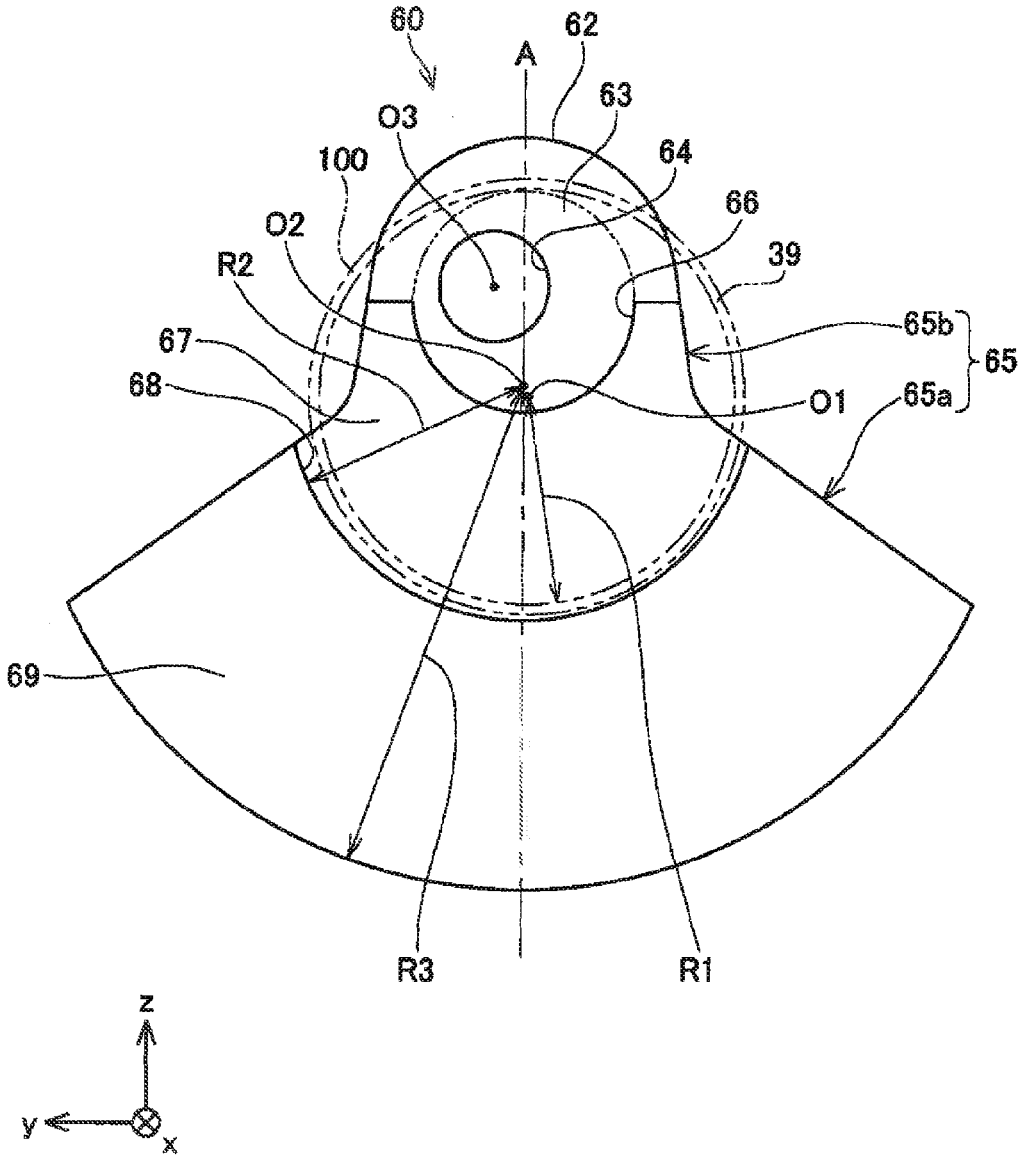
FIG. 3 shows the positional relation of the balancer-integrated bush and the rotating shaft in a state where the balancer-integrated bush is not colliding with the rotating shaft.
Figure 4:
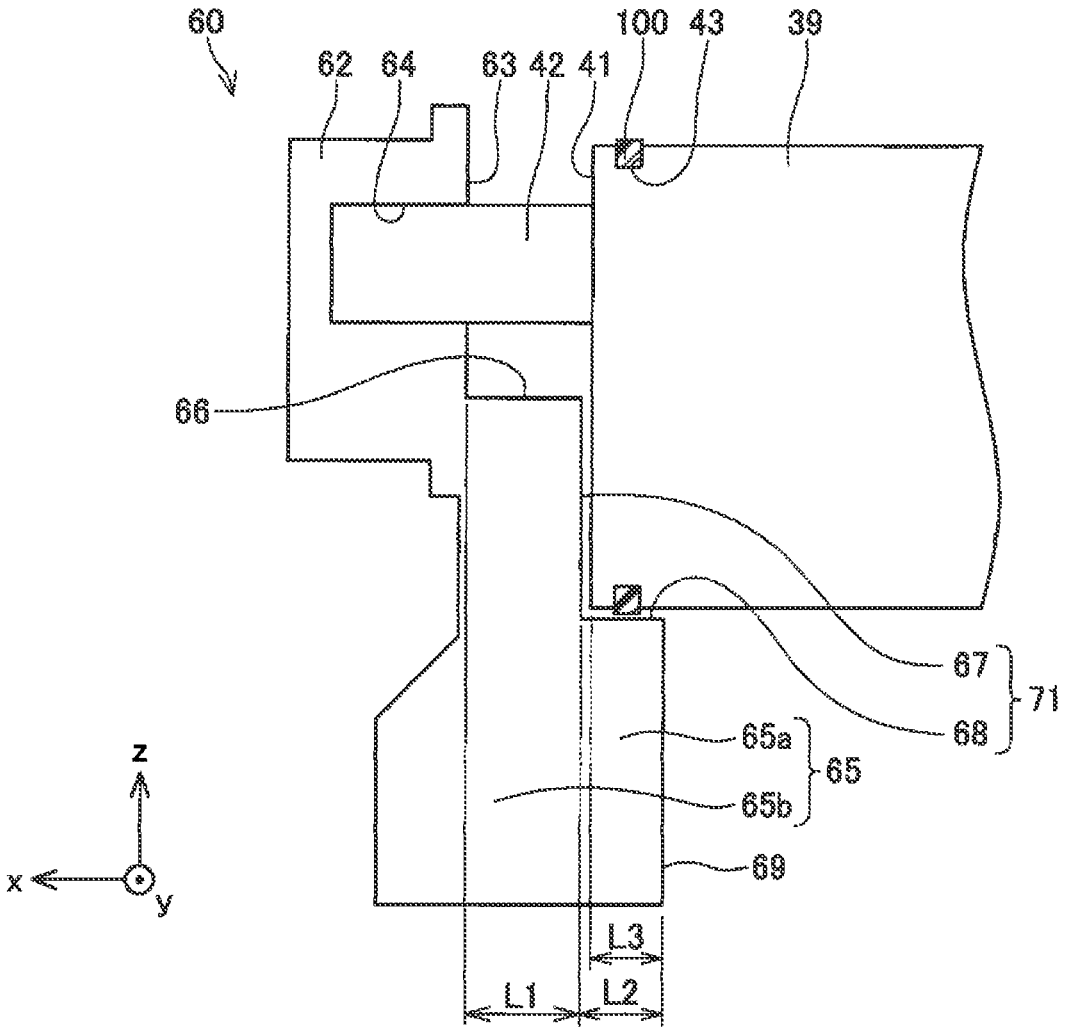
FIG. 4 is a partially enlarged view near the balancer-integrated bush of FIG. 1.

The balancer-integrated bush 60 is now explained with reference to FIG. 2 to FIG. 4. FIG. 2 is a diagram viewing the balancer-integrated bush 60 from the side on which the electric motor (30, 34) is disposed (that is, from the x direction) and, as described later, shows a state where the face 68 of the balancer-integrated bush 60 and the peripheral surface of the rotating shaft 39 are colliding at a point C (described later). FIG. 3 shows a state where the face 68 and the rotating shaft 39 are not colliding. For facilitating the explanation, in FIG. 2 and FIG. 3, the rotating shaft 39 and the O ring 100 (described later) fitted onto the rotating shaft 39 are indicated with a two-dot chain line. FIG. 4 shows a partially enlarged view near the balancer-integrated bush 60 of FIG. 1. As shown in FIG. 2 to FIG. 4, the balancer-integrated bush 60 is configured from a bush 62 and a balancer 65. The bush 62 and the balancer 65 are formed integrally. Note that, as shown in FIG. 2, when the balancer-integrated bush 60 is viewed from the front, the balancer-integrated bush 60 is of a substantially line-symmetric shape with regard to the axis A indicated with a dashed line. In other words, the shape of the balancer-integrated bush 60 on the left side (y direction) of the plane of paper with regard to the axis A is substantially the same as the inverted shape of the balancer-integrated bush 60 on the right side (−y direction) of the plane of paper with regard to the axis A. Note that the expression "shape of the balancer-integrated bush 60" used herein refers to the profile of the balancer-integrated bush 60 when the balancer-integrated bush 60 is viewed from the front in the x direction, and it should be noted that the eccentric hole 64 (described later) and the like formed on the bush 62 are not included in the foregoing shape.

The bush 62 is formed in a cylindrical shape. The movable scroll 24 is rotatably mounted on the peripheral surface of the bush 62 via a slide bearing 28. An eccentric hole 64 is formed on one face 63 (face on the side of the rotating shaft 39) of the bush 62. The eccentric hole 64 is formed at a position that is eccentric from the rotating axis of the bush 62 and is separated from the axis A. In other words, the center O3 of the eccentric hole 64 is not positioned on the axis A. An eccentric pin 42 formed on the rotating shaft 39 is inserted into the eccentric hole 64. The length of the eccentric hole 64 (that is, the depth of the eccentric hole 64) is shorter than the length of the eccentric pin 42. Thus, when the eccentric pin 42 is inserted into the eccentric hole 64, the base end portion of the eccentric pin 42 is exposed. Note that the eccentric pin 42 is formed on the other end surface 41 of the rotating shaft 39 (that is, circle of the radius R1 having the point O1 of FIG. 2 as the center thereof). Here, the point O1 indicates the shaft center of the rotating shaft 39. The eccentric pin 42 is formed at a position that is eccentric from the center axis of the rotating shaft 39. The eccentric pin 42 protrudes from the other end surface 41 of the rotating shaft 39 along the center axis direction (x direction). The eccentric pin 42 is rotatably supported by the eccentric hole 64.

The balancer 65 is formed on a side that is nearer to the rotating shaft 39 than the bush 62 is. As shown in FIG. 2 and FIG. 4, the balancer 65 is a plate-shaped member, and is configured from a body 65*b*, and a projecting portion 65*a* which projects in parallel with the rotating shaft 39 from the body 65*b* toward the rotating shaft 39. As shown in FIG. 2, the balancer 65 is formed in a substantial fan shape, and the projecting portion 65*a* is formed only at the outer peripheral part of the balancer 65. As shown in FIG. 4, the projecting portion 65*a* is projected below the rotating shaft 39 in the −x direction by an amount of the length L2. As shown in FIG. 4, the balancer 65 includes a face 66 opposing the peripheral surface of the eccentric pin 42, a face 67 orthogonal to the face 66, a face 68 orthogonal to the face 67, and a face 69 orthogonal to the face 68. The face 66 extends in parallel with the axial direction of the rotating shaft 39. The face 67 opposes the other end surface 41 of the rotating shaft 39. A slight gap is formed between the face 67 and the other end surface 41, and the face 67 and the other end surface 41 are not in abutment with each other. The face 68 opposes the peripheral surface of the rotating shaft 39. A slight gap is formed between the face 68 and the rotating shaft 39, and the face 68 and the rotating shaft 39 are not in abutment with each other. The face 68 is formed in a shape substantially following the peripheral surface of the rotating shaft 39. To put it differently, it could be said that a concaved portion 71 capable of housing an end part of the rotating shaft 39 is formed by the face 67 and the face 68. Since the face 69 is formed only at the outer peripheral part of the balancer 65 formed in a substantial fan shape, as shown in FIG. 2, the face 69 is formed in a shape that is substantially the same as the shape obtained by cutting out, from the fan shape of the radius R3 having the point O2 as the center thereof, the fan shape of the radius R2 having the same center and the same center angle as the foregoing fan shape. The faces 66, 67 are respectively a face configuring the body 65*b*. Moreover, the faces 68, 69 are respectively a face configuring the projecting portion 65*a*. To put it differently, the projecting portion 65*a* is a columnar body having the face 69 as its bottom face and the length L2 as its height. Note that the face 68 corresponds to an example of the "first opposing surface", and the face 67 corresponds to an example of the "second opposing surface".

The positional relation of the rotating shaft 39 and the balancer-integrated bush 60 in a state where the eccentric pin 42 is inserted into the eccentric hole 64 is now explained with reference to FIG. 4. The face 66 of the balancer 65 is protruding from the face 63 of the bush 62 in the −x direction by an amount of the length L1. Moreover, the length of the eccentric pin 42 in the axial direction is slightly longer than the sum of the length of the eccentric hole 64 in the axial direction and the length L1 of the face 66 (strictly speaking, longer by L2−L3). Thus, when the eccentric pin 42 is inserted into the eccentric hole 64, a portion of the eccentric pin 42 (strictly speaking, the portion of the length L1+L2−L3 from the base portion of the eccentric pin 42) is exposed to the outside, and a gap is formed between the face 67 and the other end surface 41. In the ensuing explanation, this exposed portion is referred to as the "exposed portion".

The O ring 100 that is attached to the rotating shaft 39 is now explained with reference to FIG. 4. The peripheral surface of the rotating shaft 39 and the face 68 of the balancer 65 are overlapping in the axial direction (x direction) by an amount of the length L3. The length L3 is slightly shorter than the length L2 (specifically, shorter in the amount of the gap between the other end surface 41 of the rotating shaft 39 and the face 67). A groove 43 is formed on the peripheral surface of the rotating shaft 39. The groove 43 is formed at a part in a distance of the length L3 from one end of the rotating shaft 39. In other words, the groove 43 is formed at a position opposing the face 68 of the balancer 65. The groove 43 is formed to make a full circle around the peripheral surface of the rotating shaft 39, and the O ring 100 is fitted onto the groove 43. The diameter of the O ring 100 (that is, a diameter of a cross section of the O ring (the same definition is applied to other O rings in the description)) is set to a thickness which enables the O ring 100 to come into abutment with the face 68 only in the vicinity of a point C (to be described later) during the rotatable motion of the balancer-integrated bush 60 relative to the rotating shaft 39. The O ring 100 is formed from resin or rubber that is compatible with the refrigerant used in the scroll compressor 10 or the lubricating oil of the scroll compressor 10. As an example of the O ring 100, HNBR, NBR or EPDM may be used, but the O ring 100 is not limited thereto, and any material that satisfies the foregoing compatibility may be used. The same applies to the elastic member used in the ensuing embodiments and modification examples. Note that the O ring 100 corresponds to an example of the "ring shaped elastic member".

The positional relation of the rotating shaft 39 and the balancer-integrated bush 60 in a state where the rotating shaft 39 is colliding with the balancer-integrated bush 60 and not colliding with the balancer-integrated bush 60 is each explained, and the operation and effect of the present embodiment are also explained.

The balancer-integrated bush 60 configured as described above rotates about the eccentric pin 42. Specifically, when the rotating shaft 39 is driven and rotates in the direction (clockwise rotation) shown with the arrow D of FIG. 2, the balancer-integrated bush 60 rotates about the eccentric pin 42. Consequently, the movable scroll 24 rotatably supported by the balancer-integrated bush 60 makes an orbital motion. The centrifugal force applied to the movable scroll 24 based on the orbital motion of the movable scroll 24 is set off by the balancer 65 of the balancer-integrated bush 60. Based on the balancer 65, the sealing properties of the compressing chamber 22*a* formed by the movable scroll 24 and the fixed scroll 26 are appropriately maintained while reducing the friction of the scroll wall surfaces of the movable scroll 24 and the fixed scroll 26.

When the drive of the rotating shaft 39 is stopped pursuant to the stoppage of the scroll compressor 10, the balancer-integrated bush 60 that was rotating around the eccentric pin 42 rotates in the direction indicated with the arrow D (clockwise rotation) due to the inertial force, and rotatably moves relative to the rotating shaft 39. Here, since the balancer-integrated bush 60 is engaged in eccentric rotation, the face 68 of the balancer 65 collides with the peripheral surface of the rotating shaft 39 at the point C of FIG. 2, and the rotatable motion relative to the rotating shaft 39 is regulated (strictly speaking, the balancer 65 collides with the rotating shaft 39 at the part of the face 68 that passes through the point C in the depth direction (x direction)). That is, the face 68 of the balancer 65 comes into line abutment with the rotating shaft 39. Here, the O ring 100 is attached to the peripheral surface of the rotating shaft 39. The diameter of the O ring 100 is set to a thickness where the O ring 100 can come into abutment only near the point C of the face 68. In other words, the diameter of the O ring 100 is set to a thickness in which the O ring 100 comes into abutment with the face 68 when the balancer-integrated bush 60 collides with the rotating shaft 39. Thus, the balancer-integrated bush 60 collides with the peripheral surface of the rotating shaft 39 via the O ring 100 near the point C of the face 68. Accordingly, the impact when the balancer-integrated bush 60 collides with the rotating shaft 39 is lightened by the O ring 100, and the collision noise is reduced. Consequently, the abnormal noise generated by the collision of the rotating shaft 39 and the balancer-integrated bush 60 when the scroll compressor 10 stops can be reduced.

FIG. 3 shows an example of a state where the balancer-integrated bush 60 is not colliding with the rotating shaft 39 (that is, a state where the balancer-integrated bush 60 is rotatably moving relative to the rotating shaft 39). In the present embodiment, the diameter of the O ring 100 is set to a thickness in which the O ring 100 comes into abutment with the face 68 when the balancer-integrated bush 60 collides with the rotating shaft 39. Thus, as shown in FIG. 3, while the balancer-integrated bush 60 is rotatably moving relative to the rotating shaft 39, the O ring 100 attached to the rotating shaft 39 is in a non-adjacent state with the face 68 of the balancer-integrated bush 60. According to the foregoing configuration, in comparison to the configuration where the O ring 100 is always in abutment with the rotating shaft 39 and the face 68 during the rotatable motion of the balancer-integrated bush 60 relative to the rotating shaft 39, the relatively movable range of the balancer-integrated bush 60 increases. Thus, the balancer-integrated bush 60 can more appropriately adjust the pressing force of the movable scroll 24 applied to the fixed scroll 26 that is generated based on the orbital motion of the movable scroll 24. In particular, even when the centrifugal force increases during the high-speed rotation of the scroll compressor 10, as a result of the balancer-integrated bush 60 rotatably moving relative to the rotating shaft 39, the balancer-integrated bush 60 can set off the centrifugal force of the movable scroll 24, and inhibit the increase in the pressing force of the scroll wall surfaces of the scrolls.

First Modification Example

A first modification example according to the first embodiment is now explained with reference to FIG. 5. In the ensuing explanation, only the points that differ from the first embodiment are explained, and the detailed explanation of configurations that are the same as the first embodiment is omitted.

Figure 5:
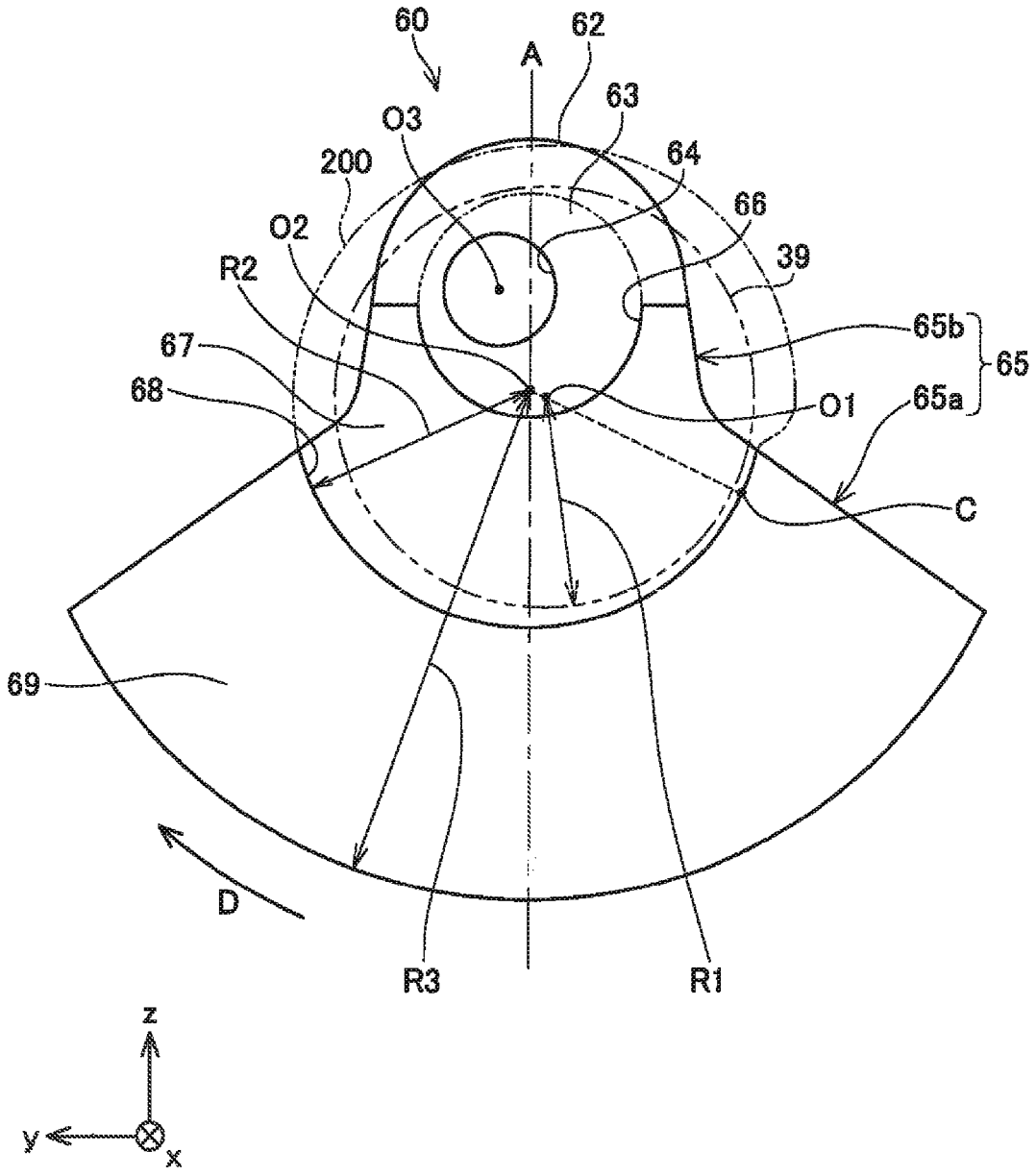
FIG. 5 shows the positional relation of the balancer-integrated bush and the rotating shaft in a state where the balancer-integrated bush is colliding with the rotating shaft in the scroll compressor according to a modification example of the first embodiment.

FIG. 5 shows a state where the balancer-integrated bush 60 is colliding with the rotating shaft 39. With the scroll compressor according to the first modification example, an O ring 200 is fitted onto the groove 43 of the rotating shaft 39. As shown in FIG. 5, the diameter of the O ring 200 is thicker than the diameter of the O ring 100, and the O ring 200 is in abutment with the face 68 of the balancer-integrated bush 60 across the peripheral direction. The balancer-integrated bush 60 can rotatably move relative to the rotating shaft 39 based on the elastic deformation of the O ring 200. Accordingly, the scroll compressor of the first modification example is configured so that the O ring 200 is always in abutment with the peripheral surface of the rotating shaft 39 and the face 68 during the rotatable motion of the balancer-integrated bush 60 relative to the rotating shaft 39.

Generally speaking, with a scroll compressor, when the compressor is activated, the balancer-integrated bush 60 rotates around the eccentric pin 42 relative to the eccentric pin 42 in a direction that is opposite to the direction of when the compressor stops. Consequently, there are cases when the movable scroll 24 orbits pursuant to the rotation of the balancer-integrated bush 60 and the scroll wall surface of the movable scroll 24 collides with the scroll wall surface of the fixed scroll 26, thereby generating an abnormal noise. This abnormal noise is considered to increase as the rotating speed of the balancer-integrated bush 60 is faster. In the first modification example, the diameter of the O ring 200 is set to be a thickness so that the O ring 200 is always in abutment with the face 68 while the scroll compressor 10 is being driven. Thus, when the scroll compressor 10 is activated and the balancer-integrated bush 60 starts to rotate, the rotational resistance of the balancer-integrated bush 60 based on the friction force arising between the O ring 100 and the face 68 increases. Consequently, the rotation angle acceleration of the balancer-integrated bush 60 decreases, and the increase in the rotating speed of the balancer-integrated bush 60 is inhibited. Accordingly, the impact upon the scroll wall surface of the movable scroll 24 colliding with the scroll wall surface of the fixed scroll 26 weakens, and the collision noise of the scroll wall surfaces of the scrolls can be reduced.

Second Modification Example

Figure 6:
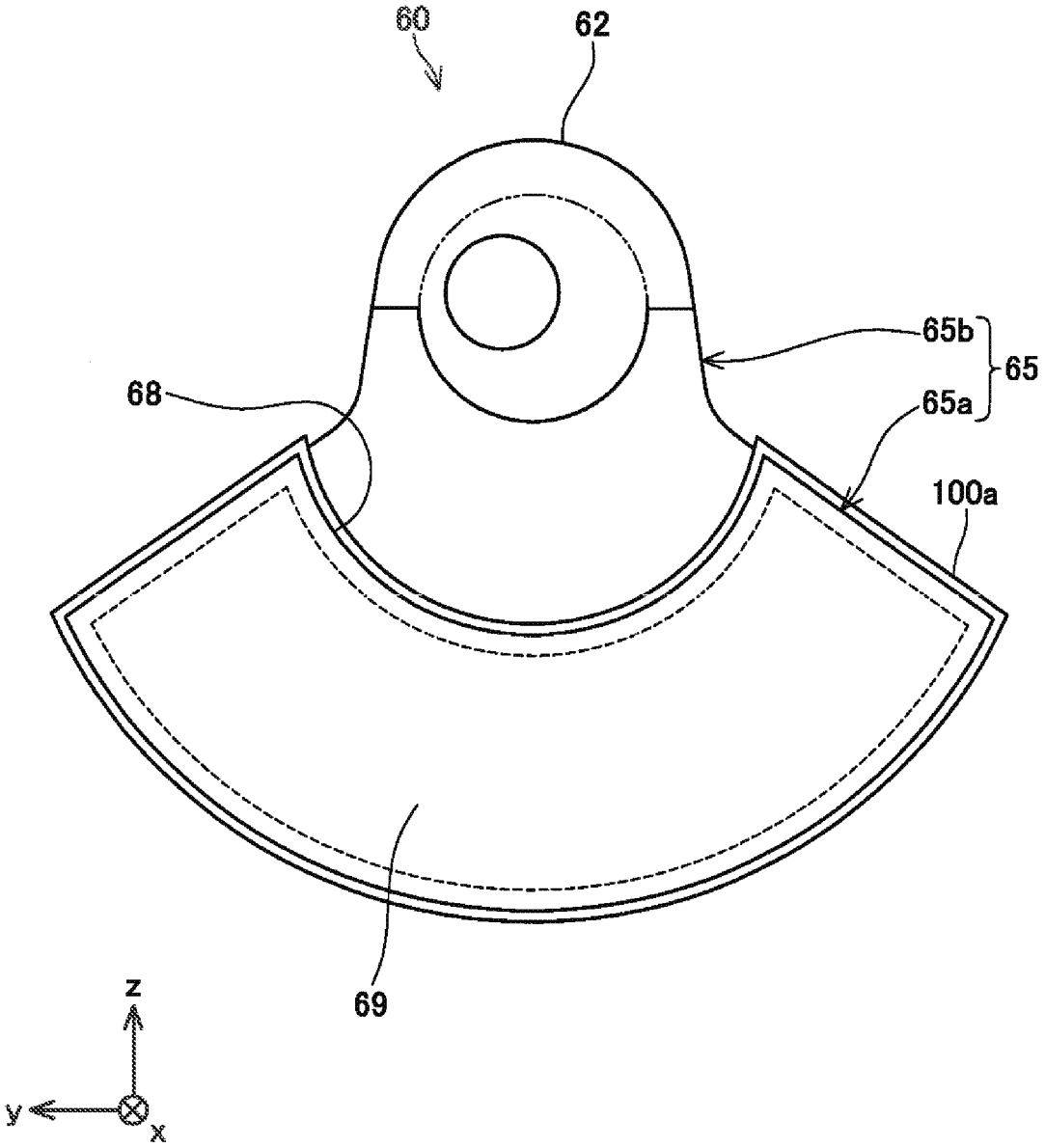
FIG. 6 is a front view of the balancer-integrated bush with the elastic member disposed thereon in the scroll compressor according to another modification example of the first embodiment.
Figure 7:
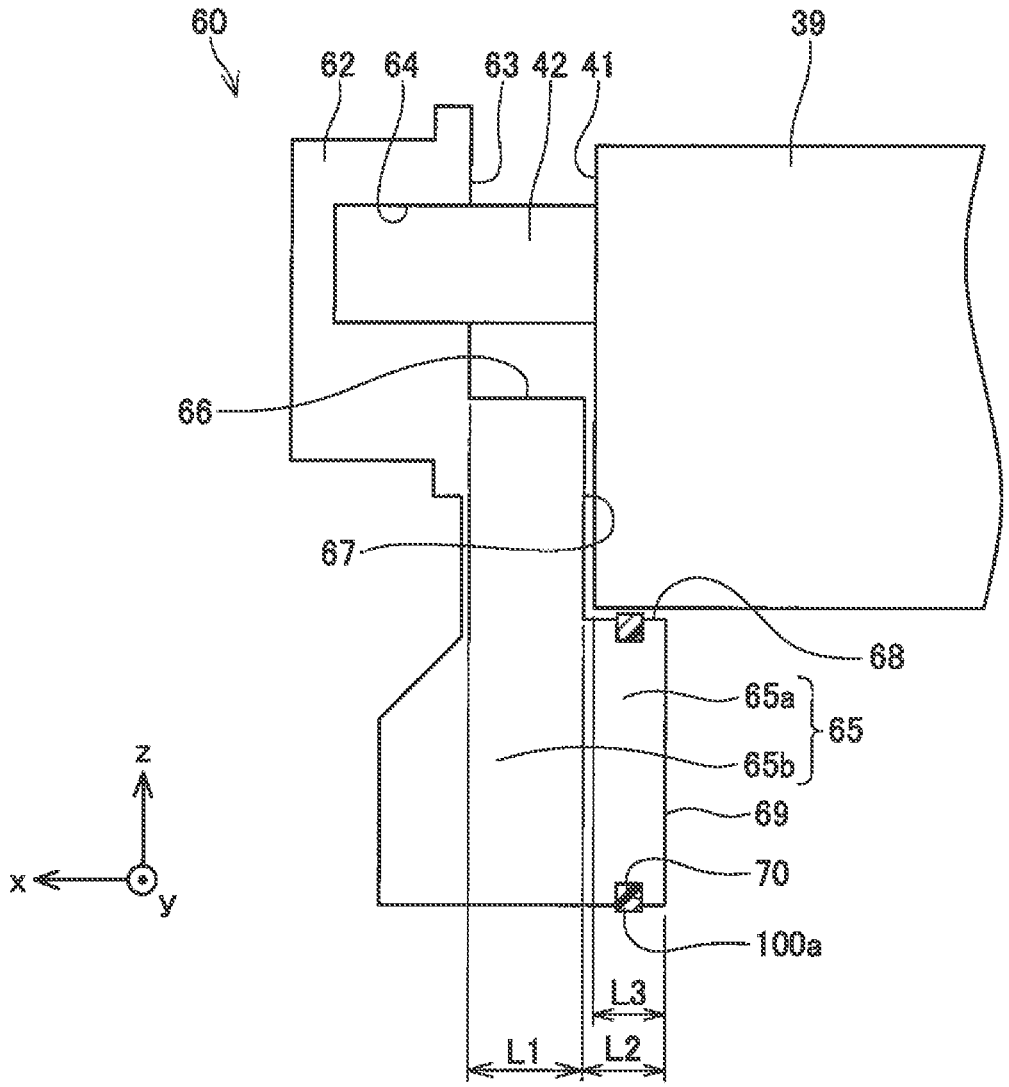
FIG. 7 is a partially enlarged view near the balancer-integrated bush of the scroll compressor according to another modification example of the first embodiment.

A second modification example according to the first embodiment is now explained with reference to FIG. 6 and FIG. 7. In the ensuing explanation, only the points that differ from the first embodiment are explained, and the detailed explanation of configurations that are the same as the first embodiment is omitted.

With the scroll compressor according to the second modification example, a groove 70 is formed on the projecting portion 65*a* of the balancer-integrated bush 60 in substitute for the groove 43 being formed on the rotating shaft 39. The groove 70 is formed to make a full circle around the side face (that is, the face that is formed substantially vertical from the face 69) including the face 68 of the projecting portion 65*a*. A circular ring 100*a* is fitted onto the groove 70. As shown in FIG. 7, the diameter of the circular ring 100*a* is set to a thickness so that the circular ring 100*a* is not always in abutment with the peripheral surface of the rotating shaft 39 while the scroll compressor 10 is being driven. Moreover, as shown in FIG. 6, the circular ring 100*a* is disposed at a part where the face 68 and the peripheral surface of the rotating shaft 39 collide. Accordingly, the scroll compressor according to the second modification example yields the same effect as the scroll compressor 10 according to the first embodiment. Note that, while the second modification example is configured so that the circular ring 100*a* is not always in abutment with the peripheral surface of the rotating shaft 39 while the scroll compressor 10 is being driven, the configuration is not limited thereto, and a configuration in which the circular ring 100*a* is always in abutment with the peripheral surface of the rotating shaft 39 while the scroll compressor 10 is being driven may also be adopted.

Second Embodiment

Figure 8:
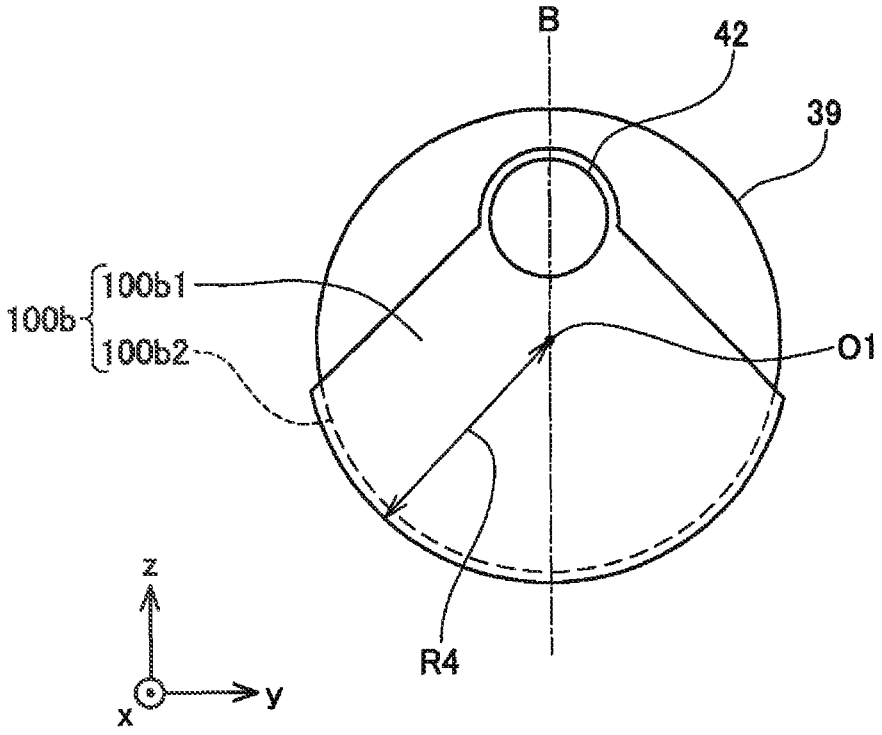
FIG. 8 is a front view of the rotating shaft on the side on which the eccentric pin is formed in the scroll compressor according to a second embodiment.
Figure 9:
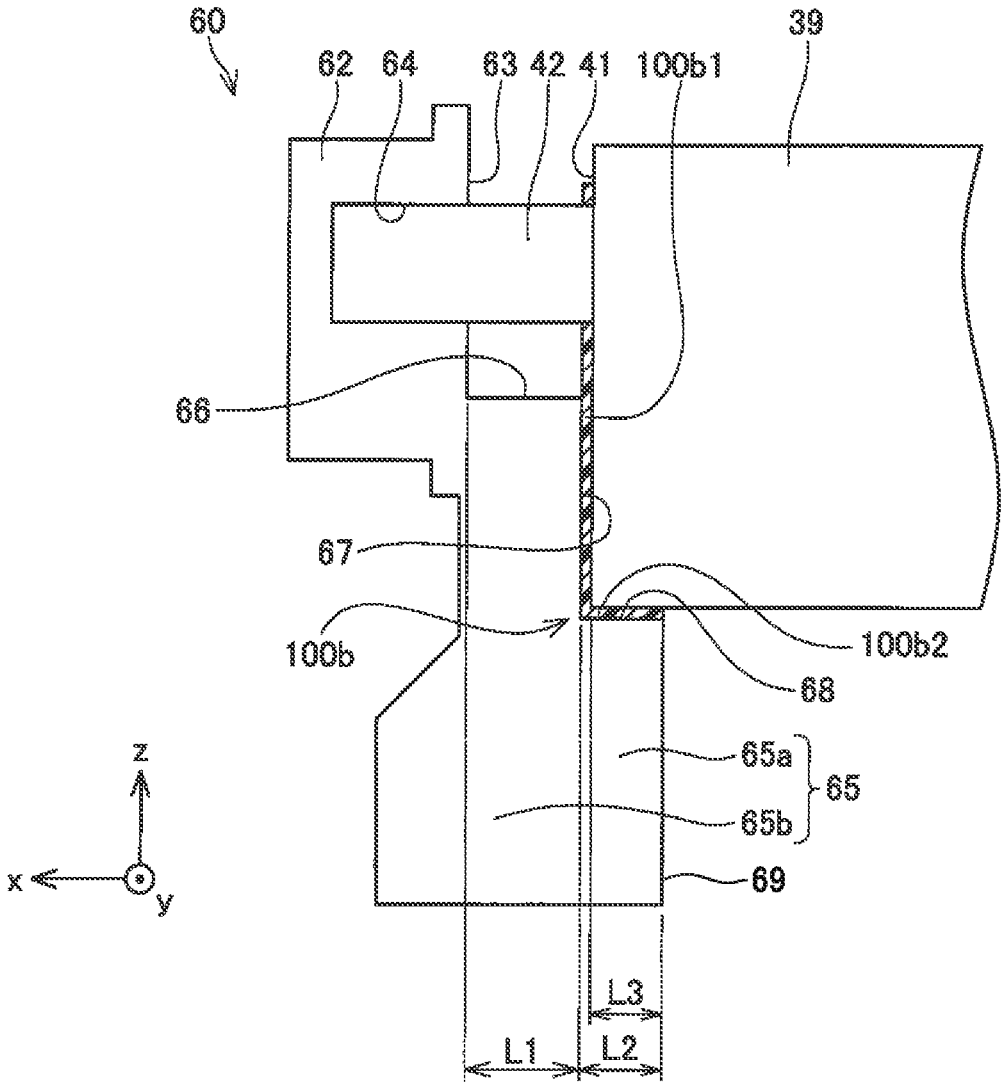
FIG. 9 is a partially enlarged view near the balancer-integrated bush of the scroll compressor according to the second embodiment.

A second embodiment is now explained with reference to FIG. 8 and FIG. 9. In the ensuing explanation, only the points that differ from the first embodiment are explained, and the detailed explanation of configurations that are the same as the first embodiment is omitted.

With the scroll compressor according to the second embodiment, a rubber sheet 100*b* is disposed between the other end surface 41 of the rotating shaft 39 and the face 67 of the balancer 65 and between the peripheral surface of the rotating shaft 39 and the face 68 in substitute for attaching the O ring 100 to one end of the rotating shaft 39. The sheet 100*b* is configured from a sheet portion 100*b*1 spreading in the yz plane, and a sheet portion 100*b*2 extending from the sheet portion 100*b*1 in the −x direction. The sheet portion 100*b*1 has a substantially line-symmetric shape with regard to the axis B indicated with a dashed line. A hole having a diameter that is substantially the same as the diameter of the eccentric pin 42 is formed on the sheet portion 100*b*1, and the center of the hole is positioned on the axis B. Moreover, the outer peripheral edge of the sheet portion 100*b*1 has a circular shape following the peripheral surface of the rotating shaft 39, and the radius R4 of this circular shape is slightly larger than the radius R1 of the rotating shaft 39. The foregoing hole formed on the sheet portion 100*b*1 is formed at a position such that the center of the circle of the circular arc of the sheet portion 100*b*1 and the center O1 of the other end surface 41 of the rotating shaft 39 overlap when the eccentric pin 42 is inserted into this hole. The sheet portion 100*b*2 extends from the circular part of the sheet portion 100*b*1 in the −x direction along the circular arc. The thickness of the sheet portion 100*b*2 is substantially the same as the difference between the radius R4 and the radius R1. In the present embodiment, the length of the sheet portion 100*b*2 in the −x direction is longer than the length L2. The sheet portion 100*b*1 has a thickness that is equal to or greater than the gap between the other end surface 41 of the rotating shaft 39 and the face 67 (L3−L2) when the eccentric pin 42 is inserted into the eccentric hole 64 of the bush 62. Moreover, the thickness of the sheet portion 100*b*2 is equal to or greater than the gap between the peripheral surface of the rotating shaft 39 and the face 68 (that is, R4−R1) in the foregoing case. Accordingly, when the eccentric pin 42 is inserted into the foregoing hole of the sheet portion 100*b*1, both faces of the sheet portion 100*b*1 come into abutment with the other end surface 41 of the rotating shaft 39 and the face 67, and both faces of the sheet portion 100*b*2 come into abutment with the peripheral surface of the rotating shaft 39 and the face 68. The balancer-integrated bush 60 can rotatably move relative to the rotating shaft 39 based on the elastic deformation of the sheet 100*b*. The sheet 100*b* can be easily positioned relative to the other end surface 41 as a result of the eccentric pin 42 being inserted into the hole formed on the sheet portion 100*b*1.

With the scroll compressor according to the second embodiment also, the same effect as the scroll compressor according to the first modification example of the first embodiment is yielded. In addition, in the present embodiment, the sheet 100*b* is also disposed on the part where the other end surface 41 of the rotating shaft 39 opposes the face 67. Thus, greater friction force is generated, and the impact during collision can be weakened and the abnormal noise can be reduced. Moreover, the impact from the collision of the rotating shaft 39 and the balancer-integrated bush 60 in the axial direction can also be lightened. Note that, while the present embodiment is configured so that the sheet 100*b* is also disposed on the part where the other end surface 41 opposes the face 67, the configuration is not limited thereto, and a configuration where the sheet is disposed only on the part at which the peripheral surface of the rotating shaft 39 opposes the face 68 may also be adopted. Moreover, while the present embodiment is configured so that the sheet portion 100*b*2 is always in abutment with the peripheral surface of the rotating shaft 39 and the face 68, the configuration is not limited thereto, and the sheet portion 100*b*2 does not need to be always in abutment with the peripheral surface of the rotating shaft 39 and the face 68 while the scroll compressor is being driven.

Third Embodiment

Figure 10:
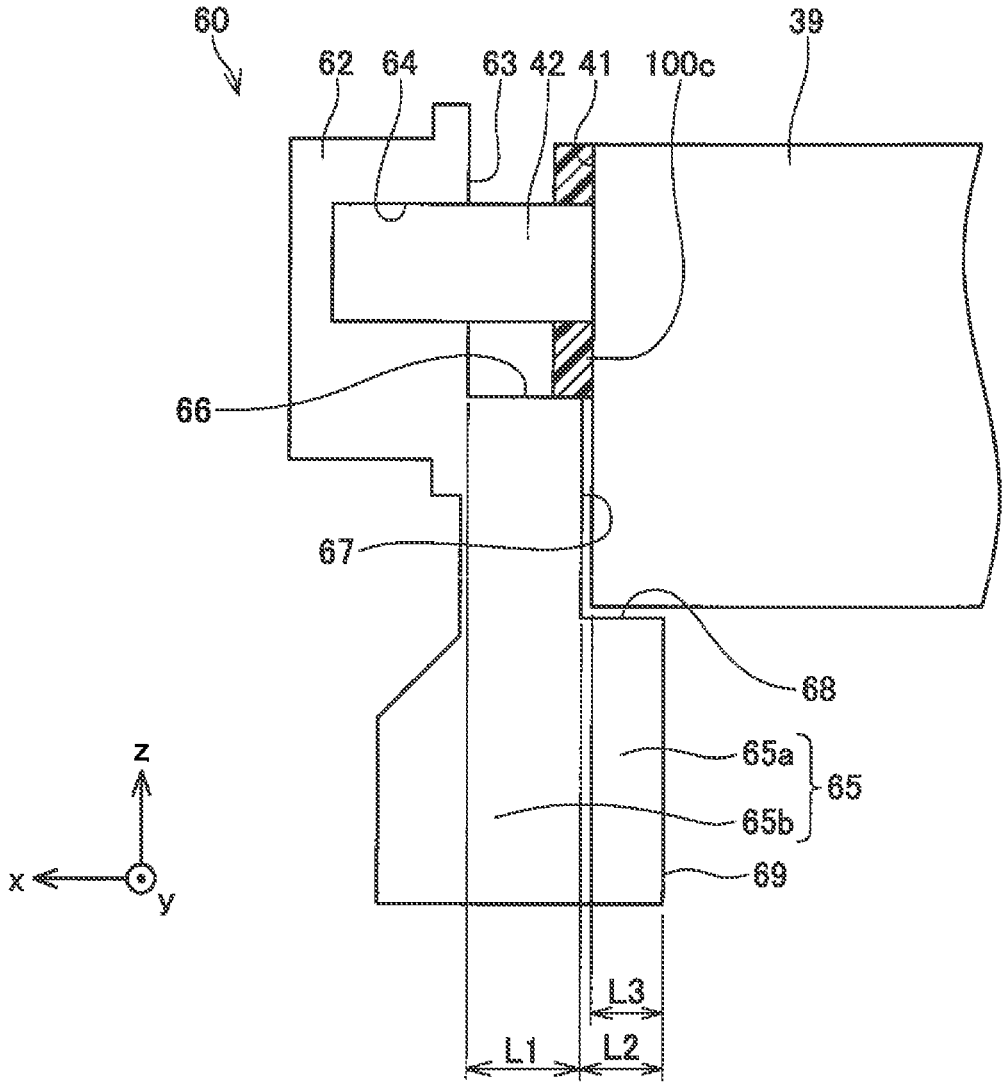
FIG. 10 is a partially enlarged view near the balancer-integrated bush of the scroll compressor according to a third embodiment.

A third embodiment is now explained with reference to FIG. 10. In the ensuing explanation, only the points that differ from the first embodiment are explained, and the detailed explanation of configurations that are the same as the first embodiment is omitted.

With the scroll compressor according to the third embodiment, an O ring 100*c* is fitted onto the base portion of the eccentric pin 42 in substitute for the O ring 100 being attached to one end of the rotating shaft 39. The diameter of the O ring 100*c* is set to be thickness in which the O ring 100*c* comes into abutment with the face 66 of the balancer 65 while the scroll compressor is being driven. Moreover, the width of the O ring 100*c* in the x direction is set to be longer than the difference between the length L2 and the length L3. Thus, when the O ring 100*c* is attached to the base portion of the eccentric pin 42, the O ring 100*c* comes into abutment with the face 66 of the balancer 65. The balancer-integrated bush 60 can rotatably move relative to the rotating shaft 39 based on the elastic deformation of the O ring 100*c*. In other words, the scroll compressor according to the third embodiment differs from the scroll compressor 10 according to the first embodiment with respect to the point that the O ring 100*c* is not disposed at the part where the balancer-integrated bush 60 collides with the rotating shaft 39 when the scroll compressor stops. According to the foregoing configuration, friction force is generated between the O ring 100*c* and the face 66 of the balancer 65 while the scroll compressor is being driven, and the rotating speed upon the balancer-integrated bush 60 colliding with the rotating shaft 39 is reduced. Thus, the impact when the face 68 of the balancer 65 collides with the peripheral surface of the rotating shaft 39 is weakened, and the abnormal noise that is generated during the collision is reduced. While the O ring 100*c* was attached to the base portion of the eccentric pin 42 in the present embodiment, the configuration is not limited thereto. The O ring 100*c* may be attached to an arbitrary location of the exposed portion of the eccentric pin 42 as long as the O ring 100*c* is configured to come into abutment with the face 66 while the scroll compressor is being driven. Moreover, while the O ring 100*c* is configured to constantly come into abutment with the face 66 while the scroll compressor is being driven in the present embodiment, the configuration is not limited thereto. The O ring 100*c* does not need to be always in abutment with the face 66 while the scroll compressor is being driven as long as the balancer-integrated bush 60 is configured so that the rotating speed of the balancer-integrated bush 60 is reduced upon colliding with the rotating shaft 39.

Fourth Embodiment

Figure 11:
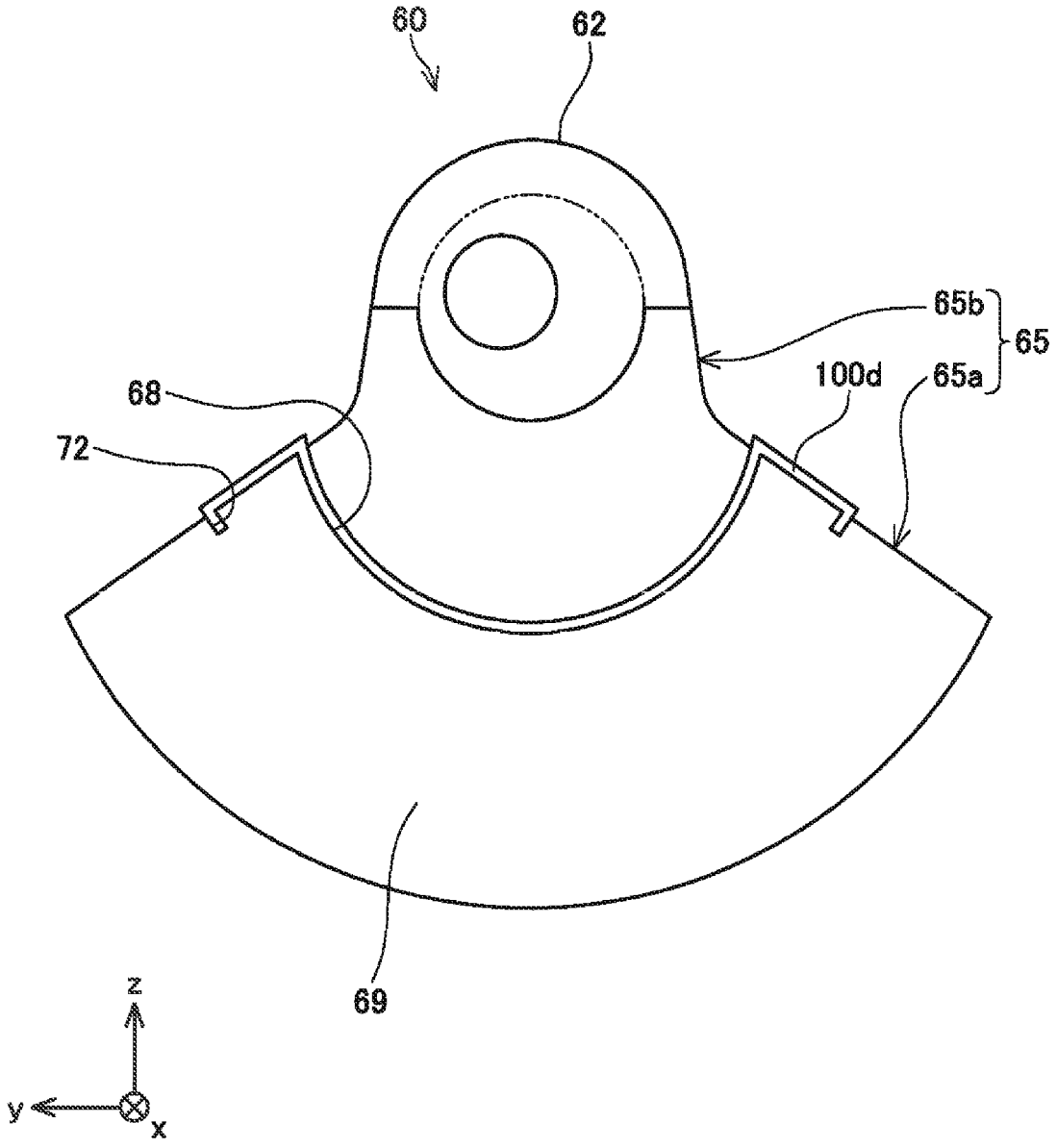
FIG. 11 is a front view of the balancer-integrated bush with the elastic member disposed thereon in the scroll compressor according to a fourth embodiment.
Figure 12:
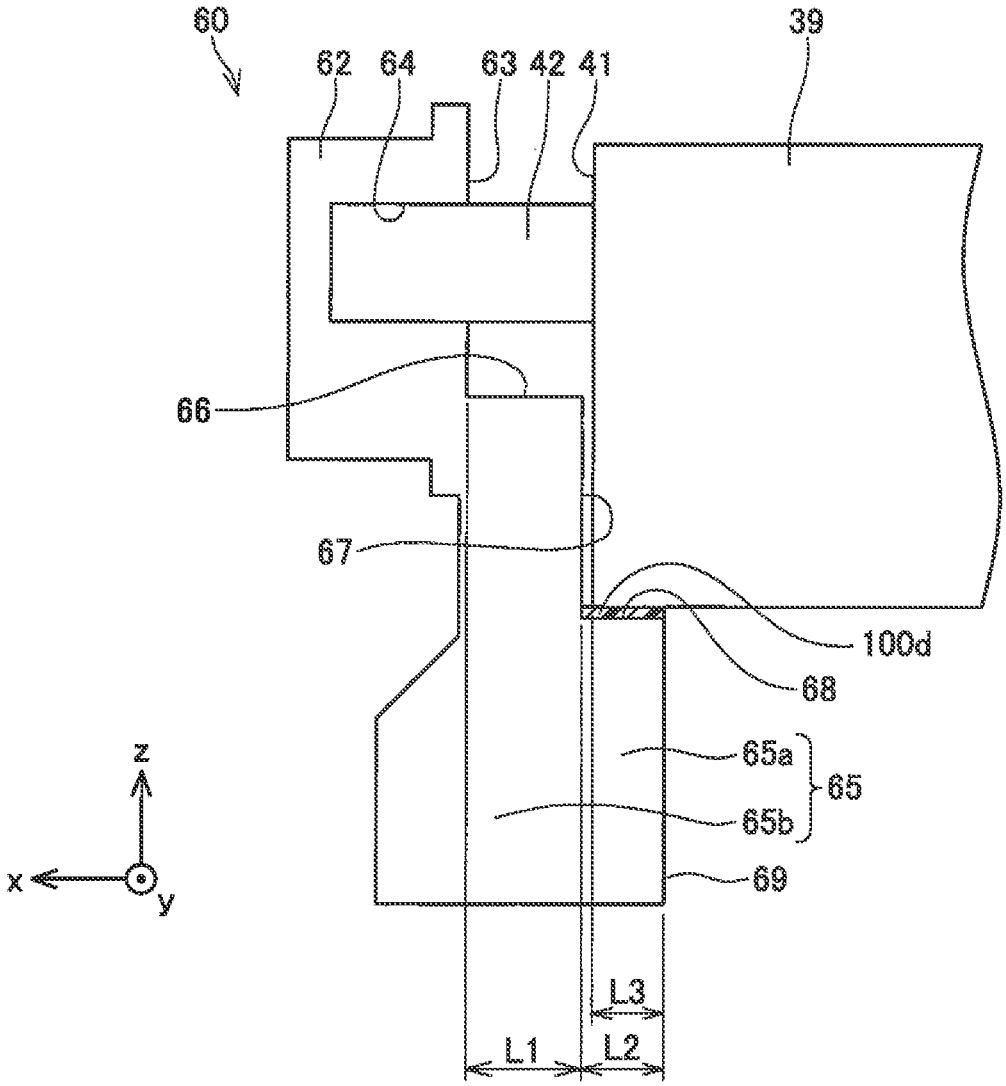
FIG. 12 is a partially enlarged view near the balancer-integrated bush of the scroll compressor according to the fourth embodiment.

A fourth embodiment is now explained with reference to FIG. 11 and FIG. 12. In the ensuing explanation, only the points that differ from the first embodiment are explained, and the detailed explanation of configurations that are the same as the first embodiment is omitted.

With the scroll compressor according to the fourth embodiment, two grooves 72 are formed on the projecting portion 65*a* of the balancer 65. Specifically, one groove 72 each is formed on two faces configured as a plane among the four side faces of the projecting portion 65*a*. The grooves 72 are formed at an arbitrary depth along the x direction on the foregoing face. The length of the grooves 72 in the x direction can be made to be substantially the same as the length L2 of the respective faces in the x direction. Both ends of the resin sheet 100*d* are respectively stopped in an engaged state with the two grooves 72. The sheet 100*d* is a rectangular sheet having a width that is substantially the same as the length of the grooves 72 in the x direction, and is pre-processed so that the sheet 100*d* fits along the shape of the two planes and the face 68. As a result of both ends of the sheet 100*d* being engaged with the grooves 72, the sheet 100*d* is fitted onto the projecting portion 65*a* so as to cover the face 68. The thickness of the sheet 100*d* is set so that the sheet 100*d* is always in abutment with the peripheral surface of the rotating shaft 39 while the scroll compressor is being driven. The balancer-integrated bush 60 can rotatably move relative to the rotating shaft 39 based on the elastic deformation of the sheet 100*d*. Based on this configuration also, the same effect as the first modification example of the first embodiment is yielded. Note that, while the length of the sheet 100*d* in the x direction is substantially the same as the length L2 in the present embodiment, the length of the sheet 100*d* is not limited thereto as long as the sheet 100*d* is disposed on a part opposing the peripheral surface of the rotating shaft 39. Moreover, while the present embodiment is configured so that the sheet 100*d* is always in abutment with the peripheral surface of the rotating shaft 39 while the scroll compressor is being driven, the configuration is not limited thereto, and the sheet 100*d* does not need to be always in abutment with the peripheral surface of the rotating shaft 39 while the scroll compressor is being driven.

First Modification Example

Figure 13:
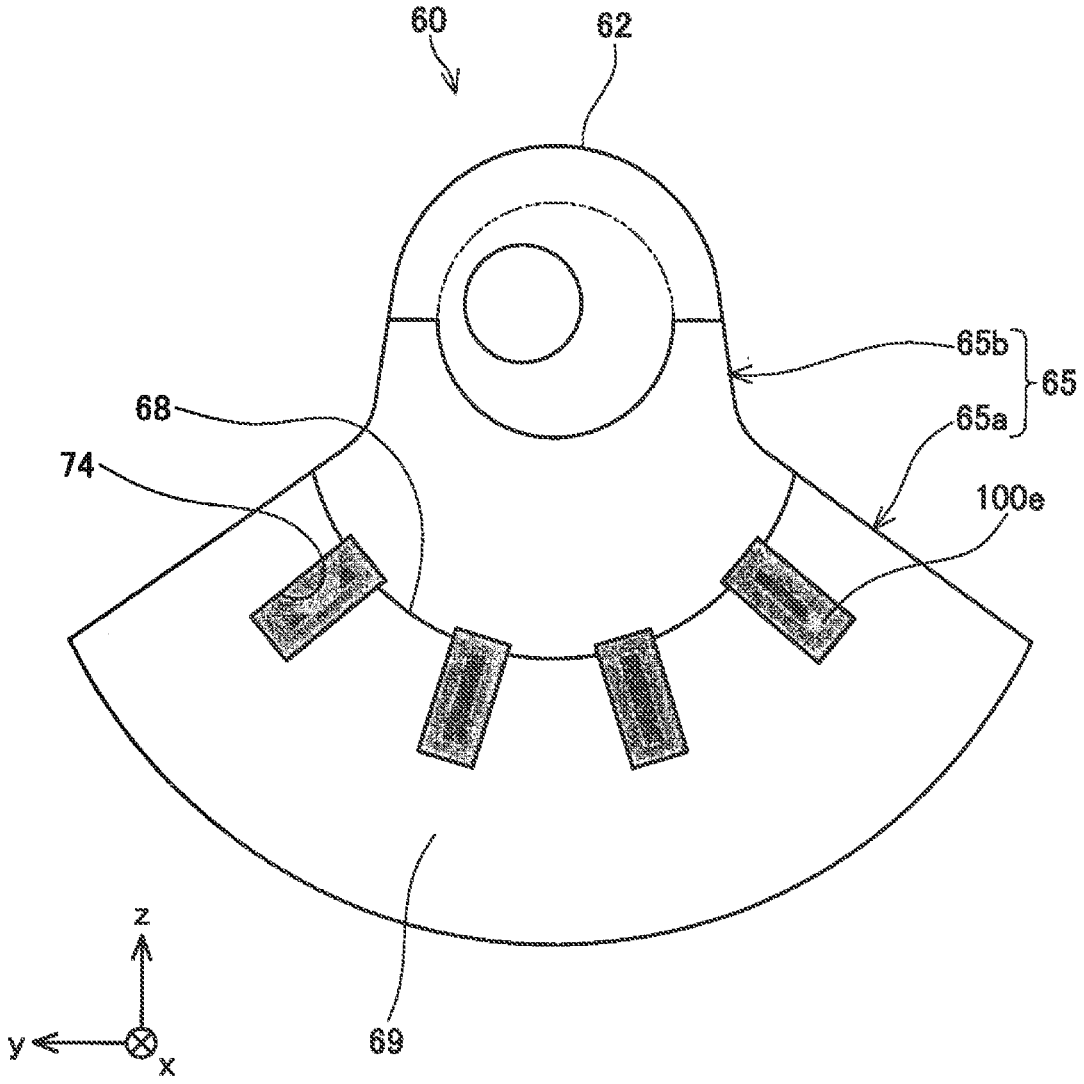
FIG. 13 is a front view of the balancer-integrated bush with the elastic member disposed thereon in the scroll compressor according to a modification example of the fourth embodiment.

A first modification example according to the fourth embodiment is now explained with reference to FIG. 13. In the ensuing explanation, only the points that differ from the fourth embodiment are explained, and the detailed explanation of configurations that are the same as the fourth embodiment is omitted.

With the scroll compressor according to the first modification example, a plurality of grooves 74 is formed on the face 68 in the depth direction of the face 68 (that is, direction that is substantially the same as the radial direction of the circle in which the point O2 of FIG. 2 is the center thereof). The length of the grooves 74 in the x direction is substantially the same as the length L2. Rubber 100*e* is filled in the grooves 74 so as to slightly protrude from the face 68. The height that the rubber 100*e* protrudes from the face 68 is set so that the upper face of the rubber 100*e* is always in abutment with the peripheral surface of the rotating shaft 39 while the scroll compressor is being driven. The balancer-integrated bush 60 can rotatably move relative to the rotating shaft based on the elastic deformation of the rubber 100*e*. With this configuration, the same effect as the first modification example according to the first embodiment can be yielded. Note that, in the first modification example, while the length of the grooves 74 in the x direction is substantially the same as the length L2, the length of the grooves 74 is not limited thereto as long as the rubber 100*e* is disposed on a part opposing the peripheral surface of the rotating shaft 39. Moreover, while the first modification example is configured so that the rubber 100*e* is always in abutment with the peripheral surface of the rotating shaft 39 while the scroll compressor is being driven, the configuration is not limited thereto, and the rubber 100*e* does not need to be always in abutment with the peripheral surface of the rotating shaft 39 while the scroll compressor is being driven.

While embodiments of the technology disclosed in this specification have been explained in detail above, the present disclosure is not limited to these embodiments, and the scroll compressor disclosed in the present specification includes the various modifications and variations of the foregoing embodiments. For example, in the foregoing embodiments and modification examples, while the elastic member is disposed on one among the rotating shaft 39, the eccentric pin 42, and the balancer-integrated bush 60, the configuration is not limited thereto. For example, the elastic member may also be disposed on both the rotating shaft 39 and the balancer-integrated bush 60, or disposed on both the rotating shaft 39 and the eccentric pin 42, or disposed on the rotating shaft 39, the eccentric pin 42, and the balancer-integrated bush 60.

What is claimed is:

1. A scroll compressor comprising:

a housing;

a cylindrical rotating shaft rotatably supported by the housing;

a fixed scroll fixed to the housing;

a movable scroll which opposes the fixed scroll to form a compressing chamber; and a drive mechanism disposed in the housing and configured to allow the movable scroll to make an orbital motion by rotation of the rotating shaft, wherein the drive mechanism includes an eccentric pin extending in parallel with the rotating shaft from an end part of the rotating shaft, and a balancer-integrated bush disposed between the eccentric pin and the movable scroll, including an eccentric hole into which the eccentric pin is inserted, configured to rotate around the eccentric pin, further including a balancer in an integrated manner, and configured to rotatably move relative to the rotating shaft, wherein an elastic member is disposed between a concaved portion of the balancer-integrated bush and the end part of the rotating shaft, and the elastic member regulates a relatively movable range in which the balancer-integrated bush rotatably moves around the rotating shaft relative to the rotating shaft, wherein a face of the balancer-integrated bush that regulates rotation of the balancer-integrated bush relative to the rotating shaft is disposed between the concaved portion of the balancer-integrated bush and the end part of the rotating shaft, and wherein the face of the balancer-integrated bush that regulates rotation of the balancer-integrated bush corresponds to a location where the elastic member is disposed.

2. The scroll compressor according to claim 1, wherein there exists a non-adjacent state in which the elastic member is not in abutment with either the balancer-integrated bush or at least one of the rotating shaft and the eccentric pin within the relatively movable range.

3. The scroll compressor according to claim 2, wherein the balancer-integrated bush comprises a body and a projecting portion which projects in parallel with the rotating shaft from the body towards the rotating shaft, the projecting portion includes a first opposing surface opposing a peripheral surface of the rotating shaft, the body includes a second opposing surface opposing an end surface of the rotating shaft, and the first opposing surface and the second opposing surface form a concaved portion capable of accommodating the end part of the rotating shaft.

4. The scroll compressor according to claim 3, wherein the elastic member is attached to a part opposing the first opposing surface within the peripheral surface of the rotating shaft, or to the first opposing surface.

5. The scroll compressor according to claim 4, wherein the elastic member is a ring shaped elastic member, and the ring shaped elastic member is attached to the rotating shaft, or to the projecting portion.

6. The scroll compressor according to claim 2, wherein the eccentric pin includes an exposed portion exposed to outside the eccentric hole, a ring shaped elastic member is attached to a peripheral surface of the exposed portion, and the ring shaped elastic member is in abutment with the balancer-integrated bush.

7. The scroll compressor according to claim 1, wherein the elastic member is always in abutment with at least one of the rotating shaft and the eccentric pin and the balancer-integrated bush within the relatively movable range.

8. The scroll compressor according to claim 7, wherein the balancer-integrated bush comprises a body and a projecting portion which projects in parallel with the rotating shaft from the body towards the rotating shaft, the projecting portion includes a first opposing surface opposing a peripheral surface of the rotating shaft, the body includes a second opposing surface opposing an end surface of the rotating shaft, and the first opposing surface and the second opposing surface form the concaved portion capable of accommodating the end part of the rotating shaft.

9. The scroll compressor according to claim 8, wherein the elastic member is attached to a part opposing the first opposing surface within the peripheral surface of the rotating shaft, or to the first opposing surface.

10. The scroll compressor according to claim 9, wherein the elastic member is a ring shaped elastic member, and the ring shaped elastic member is attached to the rotating shaft, or to the projecting portion.

11. The scroll compressor according to claim 7, wherein the eccentric pin includes an exposed portion exposed to outside the eccentric hole, a ring shaped elastic member is attached to a peripheral surface of the exposed portion, and the ring shaped elastic member is in abutment with the balancer-integrated bush.

12. The scroll compressor according to claim 1, wherein the balancer-integrated bush comprises a body and a projecting portion which projects in parallel with the rotating shaft from the body towards the rotating shaft, the projecting portion includes a first opposing surface opposing a peripheral surface of the rotating shaft, the body includes a second opposing surface opposing an end surface of the rotating shaft, and the first opposing surface and the second opposing surface form the concaved portion capable of accommodating the end part of the rotating shaft.

13. The scroll compressor according to claim 12, wherein the elastic member is attached to a part opposing the first opposing surface within the peripheral surface of the rotating shaft, or to the first opposing surface.

14. The scroll compressor according to claim 13, wherein the elastic member is a ring shaped elastic member, and the ring shaped elastic member is attached to the rotating shaft, or to the projecting portion.

15. The scroll compressor according to claim 1, wherein the balancer-integrated bush includes a first opposing surface opposing a peripheral surface of the rotating shaft, and the elastic member is attached to a part opposing the first opposing surface within the peripheral surface of the rotating shaft, or to the first opposing surface.

16. The scroll compressor according to claim 15, wherein the elastic member is a ring shaped elastic member, and the ring shaped elastic member is attached to the rotating shaft, or to the projecting portion.

17. The scroll compressor according to claim 1, wherein the eccentric pin includes an exposed portion exposed to outside the eccentric hole, a ring shaped elastic member is attached to a peripheral surface of the exposed portion, and the ring shaped elastic member is in abutment with the balancer-integrated bush.

18. A scroll compressor comprising:

a housing;

a cylindrical rotating shaft rotatably supported by the housing;

a fixed scroll fixed to the housing;

a movable scroll which opposes the fixed scroll to form a compressing chamber; and a drive mechanism disposed in the housing and configured to allow the movable scroll to make an orbital motion by rotation of the rotating shaft, wherein the drive mechanism includes an eccentric pin extending in parallel with the rotating shaft from an end part of the rotating shaft, and a balancer-integrated bush disposed between the eccentric pin and the movable scroll, including an eccentric hole into which the eccentric pin is inserted, configured to rotate around the eccentric pin, further including a balancer in an integrated manner, and configured to rotatably move relative to the rotating shaft, wherein an elastic member is disposed between the balancer-integrated bush and at least one of the rotating shaft and the eccentric pin, and the elastic member regulates a relatively movable range in which the balancer-integrated bush rotatably moves around the rotating shaft relative to the rotating shaft, wherein the balancer-integrated bush includes a first opposing surface opposing a peripheral surface of the rotating shaft, and the elastic member is attached to a part opposing the first opposing surface within the peripheral surface of the rotating shaft, or to the first opposing surface.

* * * * *